US005090030A

United States Patent [19]

Jenkins

[11] Patent Number: 5,090,030

[45] Date of Patent: Feb. 18, 1992

[54] INTEGRAL LAP COUNTER FOR RADIO-CONTROLLED MODELS

[76] Inventor: Jimmy R. Jenkins, 12150 Shiloh Rd., Dallas, Tex. 75228

[21] Appl. No.: 552,824

[22] Filed: Jul. 16, 1990

[51] Int. Cl.[5] ..... H04B 7/12; H04B 1/034

[52] U.S. Cl. ..... 377/5; 377/9; 455/66

[58] Field of Search ..... 377/5, 9, 15, 24.1, 377/24.2; 455/41, 39, 66, 345

[56] References Cited

U.S. PATENT DOCUMENTS 3,383,595 5/1968 Obata ..... 455/41
3,434,150 3/1969 Wernlund ..... 377/9
3,492,582 1/1970 Heywood ..... 455/66
3,531,118 9/1970 Mabie et al. ..... 377/5
3,946,312 3/1976 Oswald et al. ..... 377/5
4,097,808 6/1978 Parke ..... 455/41
4,340,972 7/1982 Heist ..... 455/39
4,823,367 4/1989 Kreutzfeld ..... 377/24.2

*Primary Examiner*—John S. Heyman
*Attorney, Agent, or Firm*—T. D. Copeland

[57] ABSTRACT

A method and apparatus for counting the laps completed by a remote-controlled model that detects a spurious radio-frequency electromagnetic signal spontaneously generated by the unmodified model. Presently, each model must carry on-board lap-counting signal generating apparatus. This invention eliminates the need for such apparatus, and reduces the complexity, weight, and cost of such models.

6 Claims, 1 Drawing Sheet

* TUNED TO RECEIVE SPURIOUS RADIATION OF RACE CAR'S CONTROL SIGNAL FREQUENCY.

INTEGRAL LAP COUNTER FOR RADIO-CONTROLLED MODELS

BACKGROUND OF THE INVENTION

1. Field of Invention

This invention relates broadly to the field of remote-controlled models, and more specifically to an improved method and apparatus for counting the number of laps completed by radio-controlled models during racing competition.

2. Summary of Prior Art

Radio-controlled model racing is a popular hobby sanctioned by Radio Operated Auto Racing Inc., among other rulemaking bodies. Competition occurs not only between model cars but also model aircraft, boats, etc. Races are generally conducted on a closed-circuit racecourse and require each competing model to complete as many laps as possible within a given time period; the winner completing the largest number of laps in that time. Thus, accurate means of counting the number of laps completed by each model car, boat, etc. is necessary in determining the winner of such a competition.

Each model is controlled in terms of steering, speed, and direction by radio-frequency signals of predetermined frequency generated by a hand-held remote-control transmitter. Each model carries on-board signal receiving apparatus that utilizes the control signals of the frequency assigned to it to cause the model to respond as directed by the "driver."

Prior art lap counters detect the passage by the model of a predetermined spot on the racecourse by detecting the presence of a specific radio-frequency signal emanating from each model. Such prior art lap counters require separate signal-generating apparatus aboard each competing model. The apparatus generates a signal of a frequency unique to each competing model, that is received by the prior art lap counter, allowing the counter to register the passage of the model and to count the number of times each model passes the counter.

The present invention eliminates the need for the individual models to carry on-board lap-counting signal generation apparatus. It has been determined that the control signal receiving apparatus, necessarily present in a radio-control model, spontaneously generates a spurious radio-frequency electromagnetic signal of a frequency that is unique to, and characteristic of each competing model. This spurious signal's strength is within limits set by the F.C.C. The present invention is a means by which this unique, characteristic spurious signal can be detected by a lap counter, eliminating the need for a separate lap-counting signal-generating apparatus aboard the model.

SUMMARY OF THE INVENTION

A principal object of this invention is to provide a lap-counting device for radio-controlled models that is integral to the present design of the models themselves, and requires no additional signal-generating apparatus aboard the model itself.

A further object of this invention is to provide an integral lap counter for radio-controlled models that is less expensive than those currently available, because no additional signal-generating apparatus is necessary.

Yet another object of this invention is to provide an integral lap-counter that requires no additional circuitry or structure within the chassis of the model itself, thus reducing the complexity and weight of the model over those employing the present technology.

Other objects, advantages and features of the present invention will become apparent from a perusal of the following description and drawings.

DESCRIPTION OF PREFERRED EMBODIMENT

Figure 1:
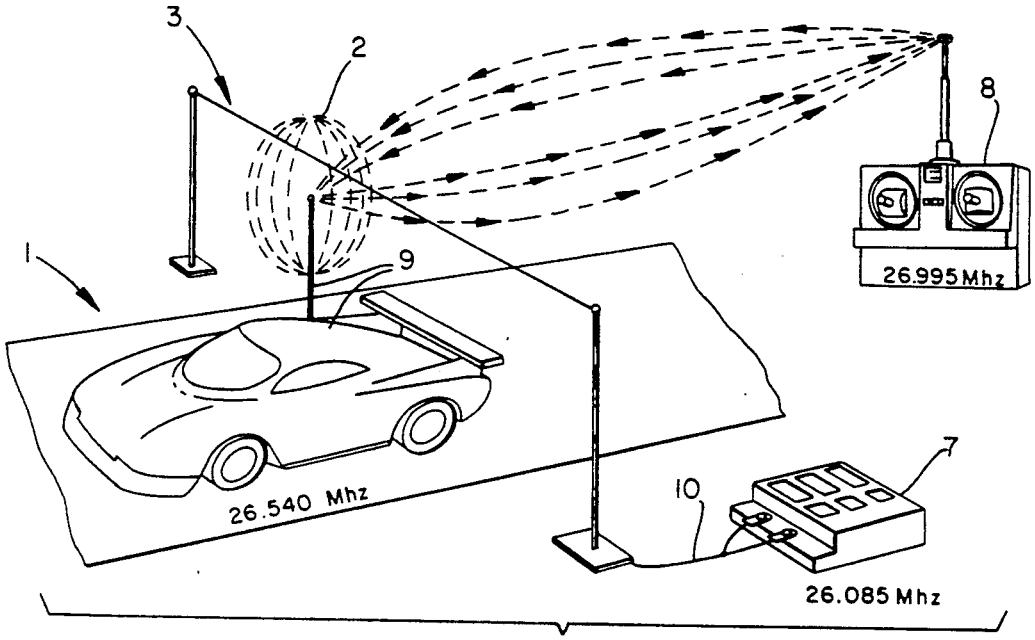
FIG. 1 is a perspective view of the invention and other relevant apparatus.
Figure 2:
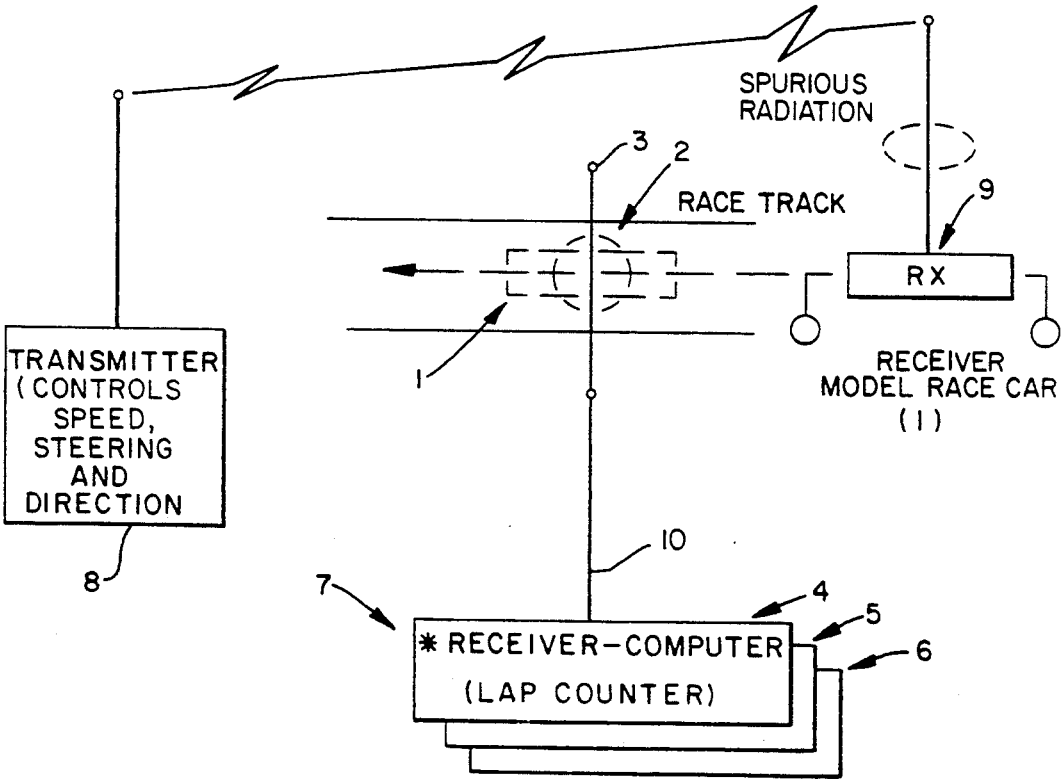
FIG. 2 is a block diagram of the system and elements of the present invention.

Referring more specifically to the drawings, it can be seen that FIG. 1 is a perspective view of a radio-controlled model racecar, the control transmitter, and the physical appearance of a preferred embodiment of the present invention. FIG. 2 is a block diagram of the electrical elements of a preferred embodiment of the invention.

For simplicity of presentation, it will be noted that this description is within the context of radio-controlled model car racing, but the invention has utility in all fields of the radio-controlled model racing hobby. Also, the preferred embodiment contemplates Amplitude Modulation transmission and reception, but the invention is equally useful in Frequency Modulation systems.

In a racing situation, the model racecar 1 is controlled as to speed, steering, and direction via radio-frequency control signals generated by transmitter 8. The transmitting apparatus 8 in the preferred embodiment transmits at 26.995 MHz, but F.C.C. regulations permit the use of other frequencies as well, and the present invention may be utilized on all such frequencies. The control signal receiving apparatus 9 aboard the racecar 1 interprets these signals into control commands, and in the process, continuously and spontaneously generates spurious radio-frequency electromagnetic radiation in the form of a noise signal 2, its strength within limits set by the F.C.C. This control signal receiving apparatus 9 oscillates at a specific frequency (in this embodiment, 26.540 MHz), different from that of any of the other competing racecars, to prevent crosstalk between the individual racecars and their respective transmitters. The spurious noise signal 2 is of the same frequency as the receiving apparatus 9, and thus also is different from that generated by any other car competing in a given race. Therefore, this spurious noise signal 2 may serve as a characteristic identifier of each individual racecar competing in a race.

As the racecar 1 passes the point on the track at which laps are to be counted, the spurious noise signal 2 is gathered into the lap counter by antenna 3. The antenna is constructed in one of several ways, all well known in the art.

The antenna transmits the signal 2 to the lap counter itself 7 through conductors 10. The lap counter 7 contains a receiver circuit, shown as 4 in FIG. 2, that detects, amplifies, and discriminates from ambient radio-frequency electromagnetic radiation, the spurious noise signal 2. This receiver circuit 4 oscillates at 26.085 MHz in the preferred embodiment to allow mixing through a bandpass filter such that a more useful intermediate frequency of 455 KHz is produced for carrying out the function of the lap counter. The receiver circuit 4 possesses the ability to detect these spurious signals 2 of a variety of frequencies, each corresponding to those signals characteristic of each racecar. The receiver circuit is capable of detecting signals of power on the order of 0.0005 Watts, and is constructed using crystal oscillator or digital synthesis technology, as is well known in the art.

Upon detection of the appropriate spurious signal 2 from the passing racecar 1, a counting circuit, shown as 5 in FIG. 2, takes note of the presence of such signal electronically, thus recording a passage or lap of the racecar itself. The counting circuit also records electronically the time interval elapsed between successive laps of each car. The counting circuit 5 is constructed using known digital integrated circuitry.

After the counting circuit 5 has registered the passage of the car, a signal is sent to an electronic external display circuit, shown as 6 in FIG. 2, that indicates the cumulative number of passages under the antenna 3 (and thus laps), and the time interval between successive passages made by each racecar. A separate display is provided for each car in the race for ease of reference. The external display circuit 6 is constructed using liquid crystal or light emitting diode circuitry.

What has been described is a superior and improved method of counting the number of laps completed by a radio-controlled model racecar. This new method eliminates the need for bulky, expensive, and complex additional circuitry aboard the racecar as was required by the prior art.

While the present invention is described in connection with the preferred embodiment thereof, it should be apparent that other embodiments may be utilized in keeping with the spirit and scope of the present invention that is defined by the appended claims.

What is claimed is:

1. A method for counting the number of laps a radio controlled vehicle makes around a race course by providing radio controlled vehicles in which the receiver thereof inherently generates a lower power band of spurious frequencies, each having an individual characteristic or signature, and then detecting spurious radio-frequency electromagnetic signals spontaneously generated by, and individually characteristic of the radio receiver in each of said vehicles.

2. A method for counting the number of laps a radio controlled vehicle makes past a finish line, comprising the steps of providing a radio controlled vehicle in which the receiver inherently generates a spurious frequency having an identifiable signature, and then detecting the number of times said identifiable signature passes said finish line to provide a count of the number of laps said vehicle has traversed.

3. A method for counting the number of times that a radio controlled vehicle passes an antenna, comprising the steps of providing a radio controlled vehicle in which the receiver inherently generates a spurious frequency radiation having an identifiable signature, and then detecting the number of times said radiation passes said antenna, and then providing a count of said number.

4. A lap counting apparatus for radio controlled vehicles in which the receivers thereof inherently generate a lower power band of spurious electromagnetic frequencies having their own individual characteristic or signature, comprising an antenna located at the point of lap completion capable of detecting said spurious frequency, and means for counting and displaying the number of laps completed by said vehicle.

5. A system for counting the number of laps that a radio controlled vehicle makes around the race course, comprising: a radio receiver in said vehicle that inherently generates a low power band of spurious frequency, having an individual signature, an antenna at a location of said race course capable of detecting said individual signature when said vehicle passes said antenna, and means to count the number of such occurrences.

6. A system for counting the number of times that a radio controlled vehicle passes a given point, comprising: a radio receiver on said vehicle that inherently generates a spurious frequency having an individual signature, an antenna located at said given point capable of detecting said individual signature when said vehicle passes close by said antenna, and means to count the number of occurrences.

* * * * *